United States Patent [19]

Yamato

[11] Patent Number: 4,744,345

[45] Date of Patent: May 17, 1988

[54] AIR-FUEL RATIO FEEDBACK CONTROL METHOD FOR INTERNAL COMBUSTION ENGINES

[75] Inventor: Akihiro Yamato, Wako, Japan

[73] Assignee: Honda Giken Kogyo K.K., Tokyo, Japan

[21] Appl. No.: 945,878

[22] Filed: Dec. 23, 1986

[30] Foreign Application Priority Data

Dec. 28, 1985 [JP] Japan ..... 60-299055

[51] Int. Cl.[4] ..... F02D 41/10

[52] U.S. Cl. ..... 123/489; 123/492

[58] Field of Search ..... 123/440, 489, 492

[56] References Cited

U.S. PATENT DOCUMENTS 4,187,812 2/1980 Hosaka et al. ..... 123/440

4,485,482 5/1984 Hasegawa et al. ..... 123/489

*Primary Examiner*—Tony M. Argenbright

*Attorney, Agent, or Firm*—Arthur L. Lessler

[57] ABSTRACT

A method of controlling in a feedback manner the air-fuel ratio of an air-fuel mixture supplied to an internal combustion engine to desired values by correcting the fuel quantity supplied to the engine by means of a correction coefficient which varies in response to output from an exhaust gas ingredient concentration sensor arranged within an exhaust passage, when the engine is operating in an air-fuel ratio feedback control effecting region. When the engine is operating in a predetermined accelerating condition, a mean value of the correction coefficient is calculated and stored. When the engine subsequently enters the predetermined accelerating condition, the air-fuel ratio feedback control is effected using the stored mean value as an initial value of the correction coefficient.

6 Claims, 7 Drawing Sheets

AIR-FUEL RATIO FEEDBACK CONTROL METHOD FOR INTERNAL COMBUSTION ENGINES

BACKGROUND OF THE INVENTION

This invention relates to a feedback control method of controlling the air-fuel ratio of a mixture being supplied to an internal combustion engine, and more particularly to a method of this kind, which is applied when the engine is operating in a predetermined accelerating condition in the course of transition into a feedback control effecting region.

A fuel supply control method for an internal combustion engine, particularly a gasoline engine, has been proposed, e.g. by U.S. Pat. No. 4,445,482 issued May 1, 1984, which determines the valve opening period of a fuel injection device for control of the fuel injection quantity, i.e. the air-fuel ratio of an air-fuel mixture being supplied to the engine, by first determining a basic value of the valve opening period as a function of engine rotational speed and intake pipe absolute pressure and then correcting the basic value through addition of constants and/or multiplication by coefficients, which are functions of engine operating parameters such as engine rotational speed, intake pipe absolute pressure, engine coolant temperature, throttle valve opening, exhaust gas ingredient concentration (oxygen concentration), etc., by electronic computing means.

According to this proposed method, while the engine is operating in a normal operating condition, the air-fuel ratio is controlled in closed loop or feedback mode such that the valve opening period of the fuel injection device is controlled by varying the value of a coefficient in response to the output of an exhaust gas ingredient concentration sensor ($O_2$ sensor) which is arranged in the exhaust system of the engine, so as to attain a stoichiometric mixture ratio or a value close thereto, whereas while the engine is operating in one of particular operating conditions (e.g. a mixture-leaning region, a wide-open-throttle region, and a fuel-cut effecting region), the air-fuel ratio is controlled in open loop mode by the use of a mean value of values of the above coefficient applied during the preceding feedback control, together with an exclusive coefficient corresponding to the kind of the particular operating region in which the engine is then operating, thereby preventing deviation of the air-fuel ratio from a desired air-fuel ratio suitable to the particular operating region due to variations in the performance of various engine operating condition sensors and a system for controlling or driving the fuel injection device, etc., which are caused by machining tolerances or the like and/or due to aging changes in the performance of the sensors and the system, and also achieving required air-fuel ratios best suited for the respective particular operating conditions, to thus reduce the fuel consumption as well as improve the driveability of the engine.

However, according to the proposed method, when the engine is accelerated from an idling condition while it is operating in the air-fuel ratio feedback control effecting region, the feedback control based upon the coefficient dependent upon the $O_2$ sensor output has a response lag, that is, there is a delay in the increase of the fuel supply quantity that should take place with increase of the intake air quantity caused by opening of the throttle valve so that the air-fuel ratio of the mixture supplied to the engine becomes leaner than the desired value or stoichiometric mixture ratio. More specifically, the mixture instantly becomes leaner immediately after the intake air quantity is increased due to opening of the throttle valve for acceleration of the engine. However, the feedback control is such that so long as the output of the $O_2$ sensor remains either higher than a reference value corresponding to the desired air-fuel ratio, or lower than same, the fuel supply quantity is controlled by integral control, to vary at a small rate. As a result, the air-fuel ratio remains leaner for a considerable time period after engine is accelerated, whereby a considerable amount of NOx is emitted.

SUMMARY OF THE INVENTION

It is the object of the invention to provide an air-fuel ratio feedback control method for an internal combustion engine, which is capable of promptly controlling the air-fuel ratio of an air-fuel mixture to be supplied to the engine to a desired value, when the engine has entered an accelerating condition within an idling region, to thereby reduce the emission of NOx.

The present invention provides a method of controlling in a feedback manner the air-fuel ratio of an air-fuel mixture being supplied to an internal combustion engine having an exhaust passage and an exhaust gas ingredient concentration sensor arranged in said exhaust passage, to desired values by correcting a fuel quantity to be supplied to said engine by means of a correction coefficient which varies in response to output from said exhaust gas ingredient concentration sensor, when said engine is operating in an air-fuel ratio feedback control effecting region, the method comprising the steps of: (1) determining whether or not said engine is operating in a predetermined accelerating condition, (2) calculating and storing a mean value of said correction coefficient when said engine is determined to be operating in said predetermined accelerating condition, and (3) effecting said air-fuel ratio feedback control using said stored mean value as an initial value of said correction coefficient, when said engine subsequently enters said predetermined accelerating condition.

Preferably, the predetermined accelerating condition is a condition into which said engine shifts from an idling region as the opening of a throttle valve provided in said engine increases across a predetermined value.

The above and other objects, features and advantages of the invention will become more apparent from the ensuing detailed description taken in conjunction with the accompanying drawings.

DETAILED DESCRIPTION

The method according to the invention will now be described in detail with reference to the drawings showing an embodiment thereof.

Figure 1:
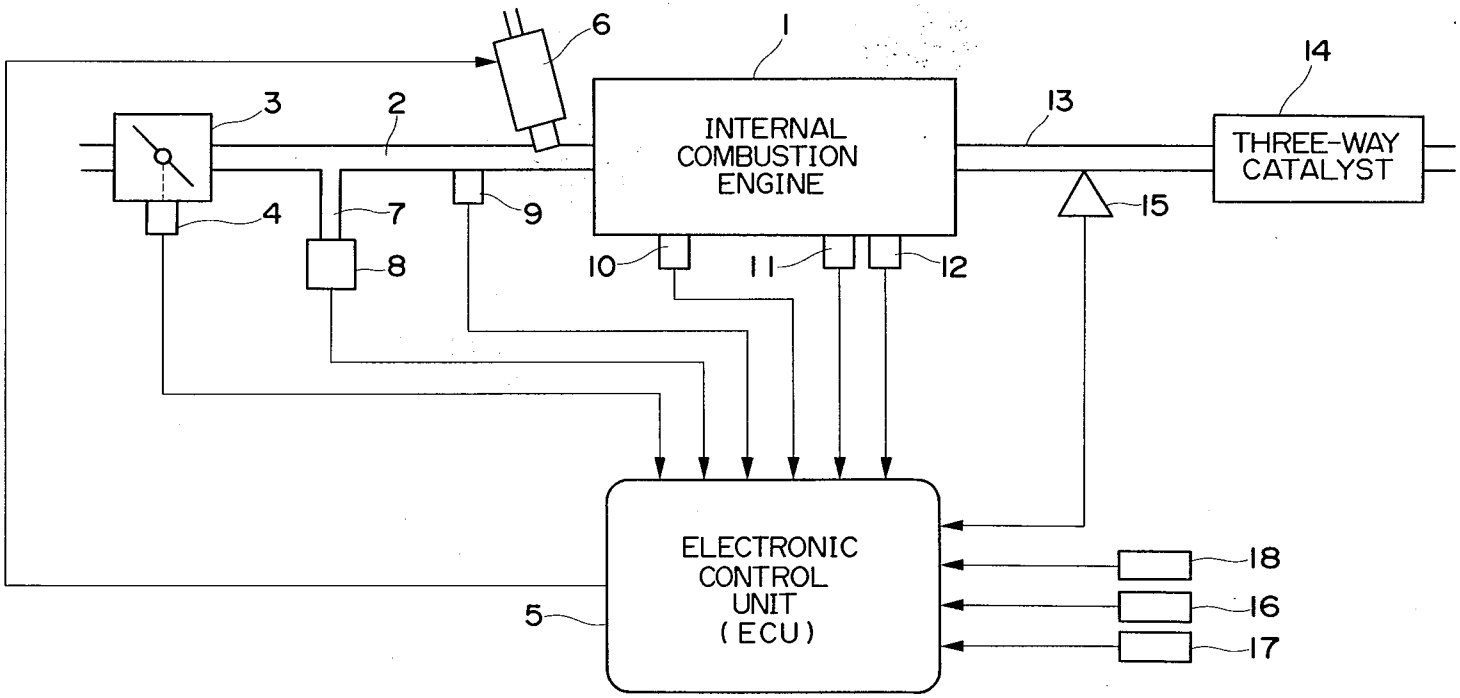
FIG. 1 is a block diagram illustrating the whole arrangement of a fuel supply control system to which is applied the method according to the invention.

Referring first to FIG. 1, there is illustrated the whole arrangement of a fuel supply control system for internal combustion engines, to which the method according to the invention is applied. Reference numeral 1 designates an internal combustion engine which may be a four-cylinder type, for instance. An intake pipe 2 is connected to the engine 1, in which is arranged a throttle valve 3, to which is connected a throttle valve opening ($\theta$TH) sensor 4 for detecting its valve opening ($\theta$TH) and converting same into an electrical signal which is supplied to an electronic control unit (hereinafter called "the ECU") 5.

Fuel injection valves 6 are arranged in the intake pipe 2 at locations between the engine 1 and the throttle valve 3, which correspond in number to the number of engine cylinders and are each arranged at a location slightly upstream of an intake valve, not shown, of a corresponding engine cylinder. These injection valves are connected to a fuel pump, not shown, and also electrically connected to the ECU 5 in 6 manner having their valve opening periods or fuel injection quantities controlled by signals supplied from the ECU 5.

On the other hand, an absolute pressure (PBA) sensor 8 communicates through a conduit 7 with the interior of the intake pipe 2 at a location immediately downstream of the throttle valve 3. The absolute pressure (PBA) sensor 8 is adapted to detect absolute pressure in the intake pipe 2 and applies an electrical signal indicative of the detected absolute pressure to the ECU 5. An intake air temperature (Tp) sensor 9 is provided at a location downstream of the absolute pressure sensor 8 for supplying the ECU 5 with an electric signal indicative of detected engine intake air temperature (Tp).

An engine coolant temperature (TW) sensor 10, which may be formed of a thermistor or the like, is mounted on the cylinder block of the engine 1 in a manner embedded in the peripheral wall of an engine cylinder having its interior filled with coolant, and is adapted to detect engine coolant temperature (TW) and applies an electrical signal indicative of the detected engine coolant temperature to the ECU 5.

An engine rotational angle position sensor (hereinafter called "the Ne sensor") 11 and a cylinder-discriminating sensor 12 are arranged in facing relation to a camshaft, not shown, of the engine 1 or a crankshaft of same, not shown. The former 11 is adapted to generate one pulse at one of particular crank angles of the engine each time the engine crankshaft rotates through 180 degrees, as a pulse of a top-dead-center position (TDC) signal, while the latter is adapted to generate one pulse at a particular crank angle of a particular engine cylinder. Pulses generated by the sensors 11, 12 are supplied to the ECU 5.

A three-way catalyst 14 is arranged in an exhaust pipe 13 extending from the cylinder block of the engine 1 for purifying ingredients HC, CO and NOx contained in the exhaust gases. An $O_2$ sensor 15 is inserted in the exhaust pipe 13 at a location upstream of the three-way catalyst 14 for detecting the concentration of oxygen ($O_2$) in the exhaust gases and supplying an electrical signal indicative of the detected oxygen concentration to the ECU 5. Further connected to the ECU 5 are an atmospheric pressure sensor 16 for detecting atmospheric pressure and an engine starter switch 17, respectively for supplying an electrical signal indicative of detected atmospheric pressure (PA) and an electrical signal indicative of its own on and off positions to the ECU 5.

Also, a battery 18 is connected to the ECU 5 for supplying the latter with operating voltage.

The ECU 5 operates in response to various engine operating parameter signals stated above, to determine operating conditions of the engine, and also to discriminate the operating region in which the engine is operating, such as an air-fuel ratio feedback control effecting region and an open loop control effecting region, and then to calculate the fuel injection period TOUT for which the fuel injection valves 6 should be opened, in accordance with the determined operating conditions and region of the engine and in synchronism with generation of pulses of the TDC signal, by the use of the following equation (1):

$$TOUT = Ti \times (KTA \times KTW \times KWOT \times KLS \times KDR \times KCAT \times KO2) + TV \quad (1)$$

where Ti represents a basic value of the valve opening period for the fuel injection valves 6, which is determined from the engine rotational speed Ne and the intake pipe absolute pressure PBA. KTA is an intake air temperature-dependent correction coefficient, KTW an engine coolant temperature-dependent correction coefficient, which have their values determined by intake air temperature TA and engine coolant temperature TW, respectively. KWOT is a mixture-enriching coefficient applicable at wide-open-throttle operation, KLS a mixture-leaning coefficient, and KDR a mixture-enriching coefficient applicable at operation of the engine in a low engine speed open loop control effecting region which the engine passes while it is being rapidly accelerated from an idling region, for the purpose of improving the driveability of the engine in such operating condition. KCAT is a mixture-enriching coefficient applicable at engine operation in a high speed open loop control effecting region, for the purpose of preventing burning of the three-way catalyst 14 in FIG. 1. This coefficient KCAT is set to larger values as the engine load increases.

KO2 represents an air-fuel ratio correction coefficient, the value of which is determined in response to an output signal from the $O_2$ sensor representing the oxygen concentration in the exhaust gases during engine operation in the feedback control effecting region. The correction coefficient KO2 has its value set to and held at respective predetermined values during engine operation in one of a plurality of particular operating regions (open loop control regions) wherein the feedback control is not effected.

TV represents a correction variable, which has its value determined in response to the battery voltage.

The ECU 5 supplies driving signals to the fuel injection valves 6 to open same over the fuel injection period TOUT calculated as above.

Figure 2:
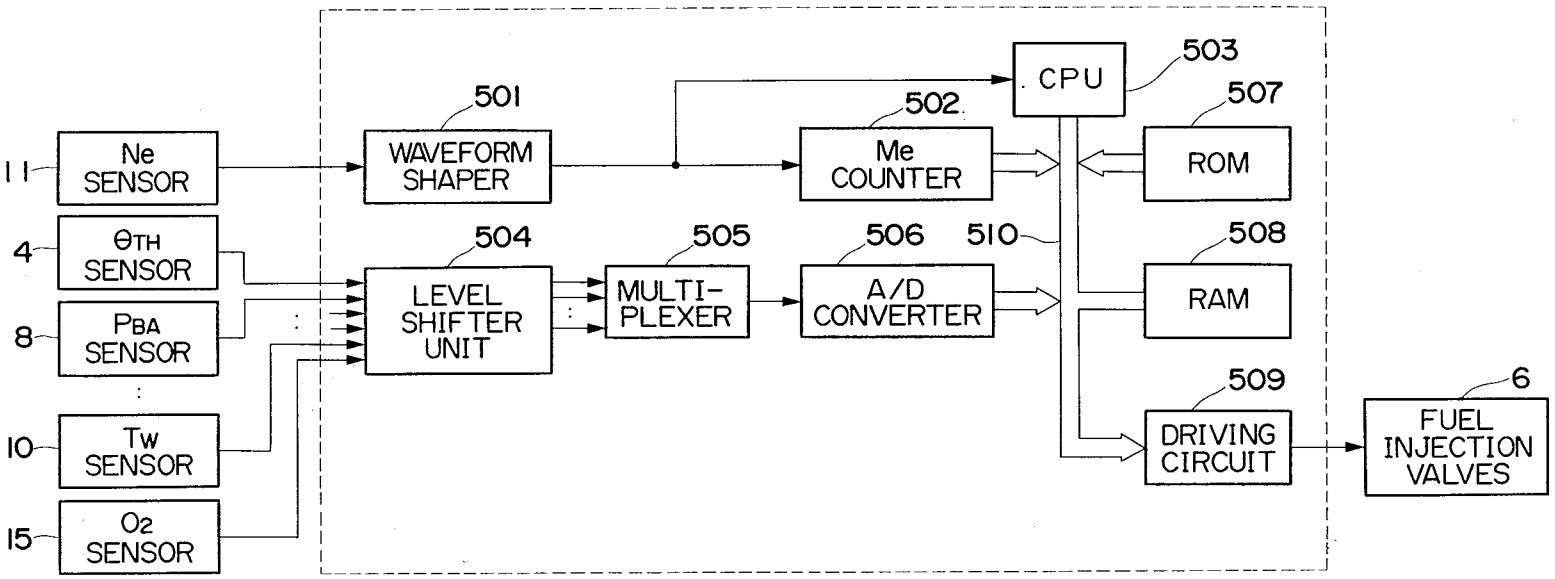
FIG. 2 is a block diagram illustrating the internal arrangement of an electronic control unit (ECU) appearing in FIG. 1.

FIG. 2 shows a circuit configuration within the ECU 5 in FIG. 1. An output signal from the Ne sensor 11 is applied to a waveform shaper 501, wherein it has its pulse waveform shaped, and the shaped signal is supplied to a central processing unit (hereinafter called "the CPU") 503, as well as to an Me value counter 502, as the TDC signal. The Me value counter 502 counts the interval of time between an immediately preceding pulse of the TDC signal and a present pulse of the same signal, which are inputted to the ECU 5 from the Ne sensor 11, and therefore its counted value Me corresponds to the reciprocal of the actual engine rotational speed Ne. The Me value counter 502 supplies the counted value Me to the CPU 503 via a data bus 510.

Respective output signals from the intake pipe absolute pressure (PBA) sensor 8, the engine coolant temperature (TW) sensor 10, the $O_2$ sensor 15, etc. have their voltage levels shifted to a predetermined voltage level by a level shifter unit 504 and successively applied to an analog-to-digital (A/D) converter 506 through a multiplexer 505.

The analog-to-digital (A/D) converter 506 successively converts into digital signals analog output voltages from various sensors outputting analog values, and the resulting digital signals are supplied to the CPU 503 via the data bus 510.

Further connected to the CPU 503 via the data bus 510 are a read-only memory (hereinafter called "the ROM") 507, a random access memory (hereinafter called "the RAM") 508, and a driving circuit 509. The RAM 508 temporarily stores various calculated values from the CPU 503, while the ROM 507 stores control programs executed within the CPU 503, a Ti map from which an appropriate value of basic fuel injection period Ti for the fuel injection valves 6 is read, maps from which predetermined values of respective correction coefficients are read, etc. The CPU 503 executes a control program stored in the ROM 507 to calculate the fuel injection period TOUT for the fuel injection valves 6 in response to the various engine operating parameter signals, and supplies the calculated value of fuel injection period to the driving circuit 509 through the data bus 510. The driving circuit 509 supplies driving signals corresponding to the above calculated TOUT values to the fuel injection valves 6 to drive same.

Figure 3:
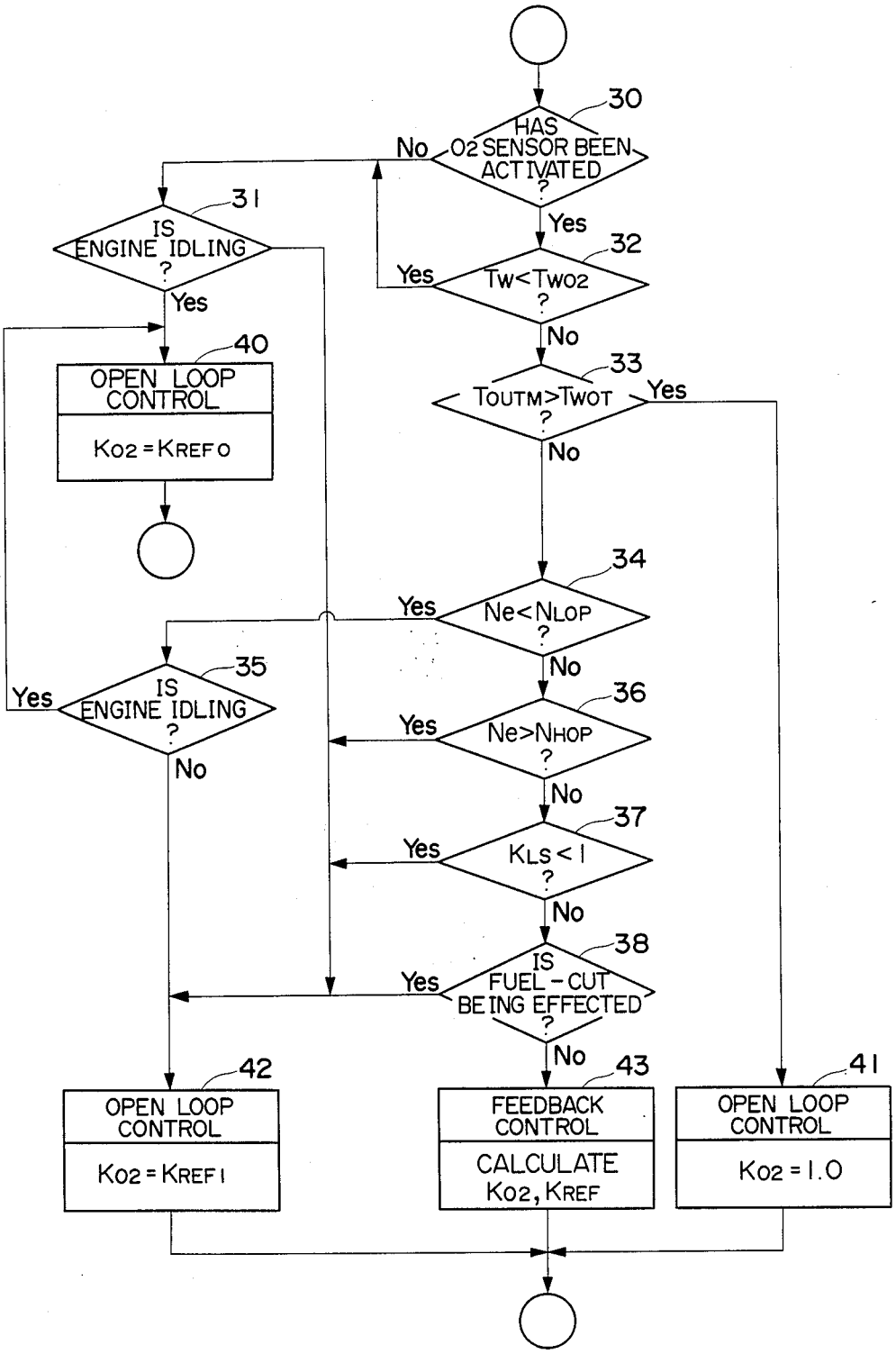
FIG. 3 is a flowchart showing a manner of executing the method according to the invention.

FIG. 3 is a flowchart showing a program for carrying out the control method according to the invention, which is executed upon generation of each TDC signal pulse.

First, it is determined at step 30 whether or not the $O_2$ sensor 15 has become activated. If the answer is No, that is, if the $O_2$ sensor 15 has not yet become activated, then it is determined at step 31 whether or not the engine is operating in an idling region I which is indicated by the symbol I in FIG. 4. At this step 31 if it is determined that the engine is in the idling region I, then open loop control of the air-fuel ratio is effected because it is assumed that the engine is idling with the $O_2$ sensor still inactive. More particularly, the determination at step 31 as to whether or not the engine is operating in the idling region I is carried out in a manner as shown in FIG. 5: It is first determined whether or not the engine rotational speed Ne is lower than an upper idling speed limit NIDL, e.g. 1000 rpm (step 310) that can be assumed when the engine is operating in the idling region I, and if the answer is Yes, a determination is made as to whether or not the intake pipe absolute pressure PBA is lower than an upper limit value PBAIDL (e.g. 350 mmHg), that can be assumed when the engine is operating in the idling region I (step 311). If the answer to the question of step 311 is Yes, it is determined that the engine is operating in the idling region I in FIG. 4 (step 312). If either or both of the answers to the questions at steps 310 and 311 are No, the engine is determined to be operating in a region other than the idling region I (step 313).

If the answer to the question at step 31 is Yes, the air-fuel ratio correction coefficient KO2 has its value set to a mean value KREF0, which has been calculated during the preceding feedback control effected while the engine was operating in the idling feedback region $I_2$ which is part of the idling region I in FIG. 4, in a manner hereinafter described in detail with reference to FIG. 7, (step 40). Incidentally, the mean value KREFO is also applied as an initial value of the correction coefficient KO2 at the start of feedback mode control in the idling region $I_2$ immediately following engine operation in an open loop control effecting region. If the answer to the question of step 31 is No, the air-fuel ratio correction coefficient KO2 has its value set to a mean value KREF1, which has been calculated during the preceding feedback control effected while the engine was operating in a feedback control effecting region other than the idling region $I_2$ (indicated by the symbol II in FIG. 4 and hereinafter called "ordinary feedback control region") in a manner hereinafter described in detail (step 42). Incidentally, the mean value KREF1 is also applied as an initial value of the correction coefficient KO2 at the start of feedback mode control in the ordinary feedback region II immediately following engine operation in an open loop control effecting region. In this way, the initial value of the correction coefficient KO2 is set to either KREF0 or KREF1, which are the mean values already calculated, depending on whether the engine has entered the idling region $I_2$ or the ordinary feedback region II, both within the feedback control effecting region.

If the answer to the question of step 30 is Yes, that is, if the $O_2$ sensor 15 has completed activation, a determination is made as to whether or not the engine coolant temperature TW is lower than a predetermined value TWO2, e.g. 70° C. (step 32), to determine whether the engine is in an operating condition where the feedback control responsive to the output signal from the $O_2$ sensor 15 should be effected. If the answer to the question of step 32 is Yes, the program proceeds to step 31, while if the answer is No, step 33 is executed.

The ground for providing the step 32 is that when the temperature TW of the engine coolant is lower than the above predetermined value TWO2, the air-fuel ratio of the mixture should not be controlled in feedback mode even with the $O_2$ sensor activated, but should be controlled in open loop mode so as to promptly warm up the engine.

Next, at step 33 in FIG. 3, it is determined whether or not the fuel injection period TOUTM is longer than a predetermined time period TWOT. This determination is made to determine whether or not the engine is operating in a wide-open-throttle region (region III in FIG. 4). If the answer is Yes, the program proceeds to step 41 to set the air-fuel ratio correction coefficient KO2 to a value of 1.0, whereby the air-fuel ratio is controlled in open loop mode with the same coefficient held at 1.0, while if the answer at step 33 is No, it is determined at step 34 whether or not the engine is operating in a low engine speed open loop control region (region IV in FIG. 4), based on whether the engine speed Ne is lower than a predetermined value NLOP (e.g. 600 rpm). If the answer at step 34 is Yes, the program proceeds to step 35 wherein it is determined whether or not the engine is operating in the idling region I in a manner similar to the manner of step 31.

If the answer at step 35 is Yes, that is, if the engine is operating in the idling region $I_1$, the program proceeds to the aforementioned step 40. On the other hand, if the answer is No, the program proceeds to the aforementioned step 42. If it is determined at this step 35 that the engine is in the idling region I, then the open loop control is effected because it is assumed that the engine has entered the idling open-loop control region $I_1$ (FIG. 4) where the engine speed Ne is lower than the predetermined value NLOP.

Figure 4:
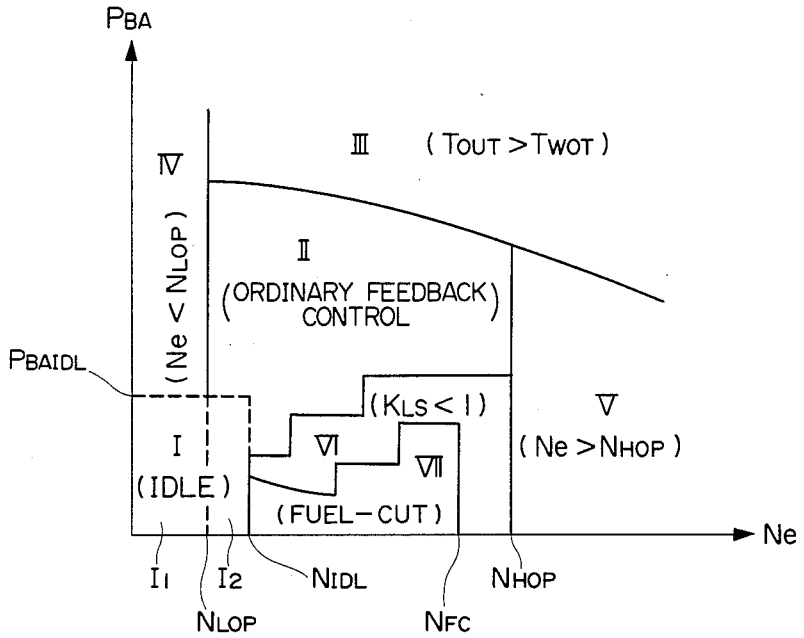
FIG. 4 is a graph showing various operating regions of the engine.
Figure 5:
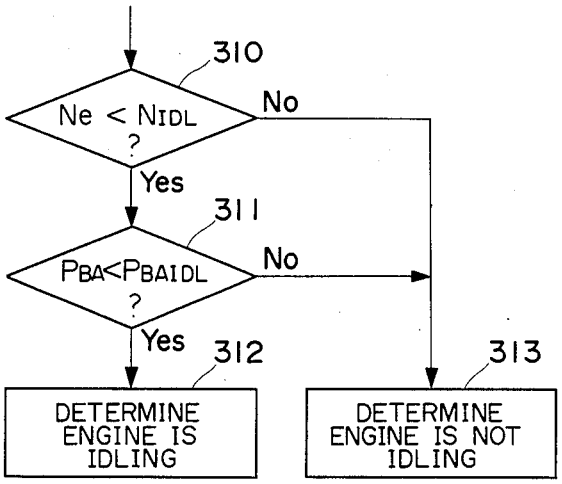
FIG. 5 is a flowchart of a subroutine for determining an idling region of the engine.

If the answer at step 34 is No, the program proceeds to step 36 where it is determined whether or not the engine speed Ne is higher than a predetermined value NHOP (e.g. 3000 rpm) to thereby decide whether the engine is operating in a high engine speed open loop control region (region V in FIG. 4). If the answer at step 36 is Yes, the program proceeds to the aforementioned step 42, while if the answer is No, it is determined at step 37 whether or not the value of the mixture-leaning correction coefficient KLS is smaller than 1.0 (i.e. $KLS<1.0$), in other words, whether or not the engine is operating in a mixture-leaning region VI in FIG. 4.

If the answer to the question at step 37 is Yes, the step 42 is executed, and if No, step 38 is executed to determine whether or not the engine is operating in a fuel-cut effecting region (region VII in FIG. 4). The determination at this step 38 is made depending on the answer to a question, for example, whether or not the throttle valve opening θTH shows a substantially fully closed position, when the engine speed Ne is lower than a predetermined value NFC (e.g. 1500 rpm), or whether or not the intake pipe absolute pressure PBA is lower than a predetermined value PBAFCj which is set to larger values as the engine speed Ne increases, when the engine speed Ne is higher than the predetermined value NFC.

Figure 6:
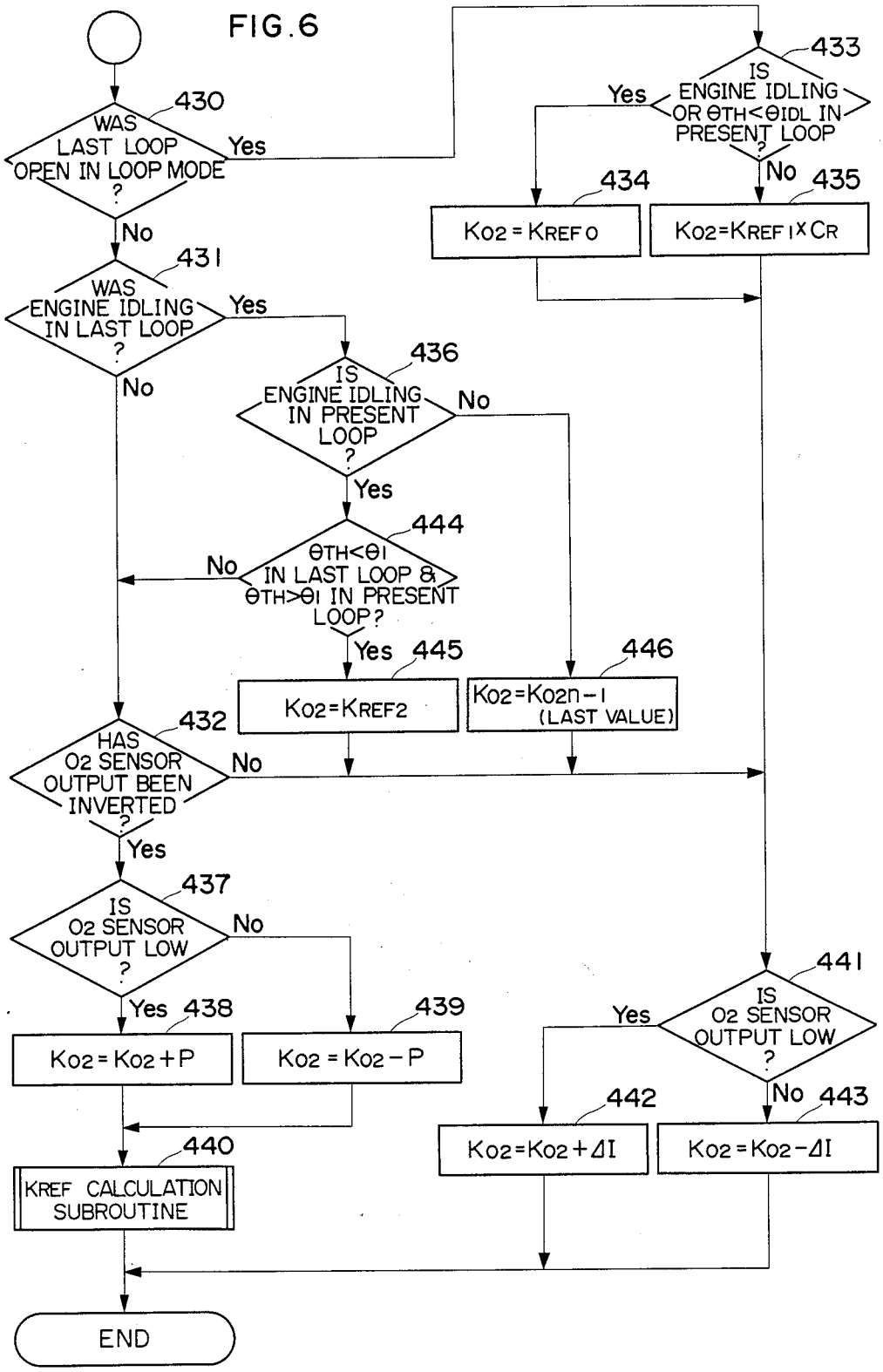
FIG. 6 is a flowchart showing in detail the step 43 in FIG. 3, in which is executed a subroutine for calculating the value of a correction coefficient KO2 applied at engine operation in the air-fuel ratio feedback control effecting region.

If the determination at step 38 provides an affirmative answer, that is, when the engine is operating in the fuel-cut effecting region, the program proceeds to the aforementioned step 42, and if the answer at step 38 is negative, it is judged that the engine is operating either in the ordinary feedback control region II in FIG. 4 or in the idling region $I_2$, whereupon calculations are made of the value of the air-fuel ratio correction coefficient KO2 to be used in the feedback control effecting region and the mean value KREF1 thereof in accordance with the program of FIG. 6 hereinafter explained (step 43). In this manner, the engine is determined to be operating in the air-fuel ratio feedback control effecting region when all the determinations at steps 33 through 38 provide negative answers, and then the feedback control is effected.

Calculation of the correction coefficient KO2 at step 43 in FIG. 3 is carried out in a manner shown in the flowchart of FIG. 6.

First, it is determined at step 430 whether or not the immediately preceding or last loop, i.e. the loop started upon generation of the immediately preceding pulse of the TDC signal, was executed in open loop mode. If the answer is No, a determination is made as to whether or not the engine was operating in the idling region I in the last loop (step 431). If the answer to the question at step 431 is No, the program proceeds to step 432, because it is then assumed that the engine was in the idling region II during the last loop.

If the answer to the question at step 430 is Yes, that is, if the last loop was executed in open loop mode, it is determined at step 433 whether or not the engine is operating in the idling region $I_2$ in the present loop, or whether or not the throttle valve opening θTH is smaller than a predetermined upper limit value θIDL that can be assumed when the engine is in the idling region $I_2$. If the answer is Yes, the correction coefficient KO2 is set to the mean value KREF0, which has been calculated during the preceding feedback control effected while the engine was operating in the idling region $I_2$ in a manner hereinafter described in detail with reference to FIG. 7 (step 434), and then integral control (I term control) of the air-fuel ratio is executed in response to the output signal from the $O_2$ sensor 15 with the newly set coefficient KO2 value or KREF0 applied as an initial value (steps 441 et seq.).

If the answer to the question at step 433 is No, the air-fuel ratio correction coefficient KO2 has its value set to a value $KREF1\times CR$, hereinafter referred to (step 435), and then the integral control of the air-fuel ratio is effected at steps 441 et seq., using the thus set coefficient KO2 value, i.e. $KREF1\times CR$, as an initial value. As stated before, the value KREF1 is the mean value of the correction coefficient KO2 obtained during operation of the engine in the ordinary feedback region II other than the idling region $I_2$. The value CR is set at such a value as to improve the overall emission characteristics of the engine, depending upon the inherent emission characteristics of the engine per se, the exhaust gas purifying characteristics of the exhaust gas purifying device 14, etc. More specifically, if it is intended to reduce the amount of exhaust gas ingredient NOx, for instance, the value CR is set at a value larger than 1.0 so that the air-fuel ratio of the mixture, which is controlled by the correction coefficient KO2 value, assumes a value richer than the stoichiometric mixture ratio. On the other hand, if it is intended to reduce the amounts of ingredients CO, HC in the exhaust gases, the value CR is set at a value smaller than 1.0 so that the resulting air-fuel ratio becomes leaner than the stoichiometric mixture ratio. Further, when the engine coolant temperature TW is low, the driveability of the engine at the start of the air-fuel ratio feedback control can be improved if the value CR is set at a value larger than 1.0.

If the answer to the question at step 430 is No and at the same time the answer to the question at step 431 is Yes, that is, if the engine was operating in the idling region $I_2$ in the last loop, it is determined at step 436 whether or not the engine is operating in the idling region $I_2$ in the present loop. If the answer is No, the program proceeds to step 446. On this occasion, it is judged that the engine operating condition has shifted from the idling region $I_2$ in FIG. 4 to the ordinary feedback control region II in FIG. 4 in the present loop, and then the initial value of the correction coefficient KO2 is set to a value $KO2n-1$, which is the value of KO2 obtained in the last loop i.e. the last KO2 value obtained in the idling region $I_2$, followed by starting the air-fuel ratio feedback control with the value $KO2n-1$ as the initial value of the coefficient KO2.

If the answer to the question at step 436 is Yes, it is determined at step 444 whether or not the throttle valve opening $\theta$TH detected in the last loop is smaller than a predetermined valve opening value $\theta$1 and at the same time that detected in the present loop is greater than the predetermined valve opening value $\theta$1. This step is for determining whether or not the engine operating condition has just shifted from the idling region to a predetermined accelerating condition within the feedback control effecting region through increasing of the opening of the throttle valve 3 in the intake pipe 2.

Figure 7:
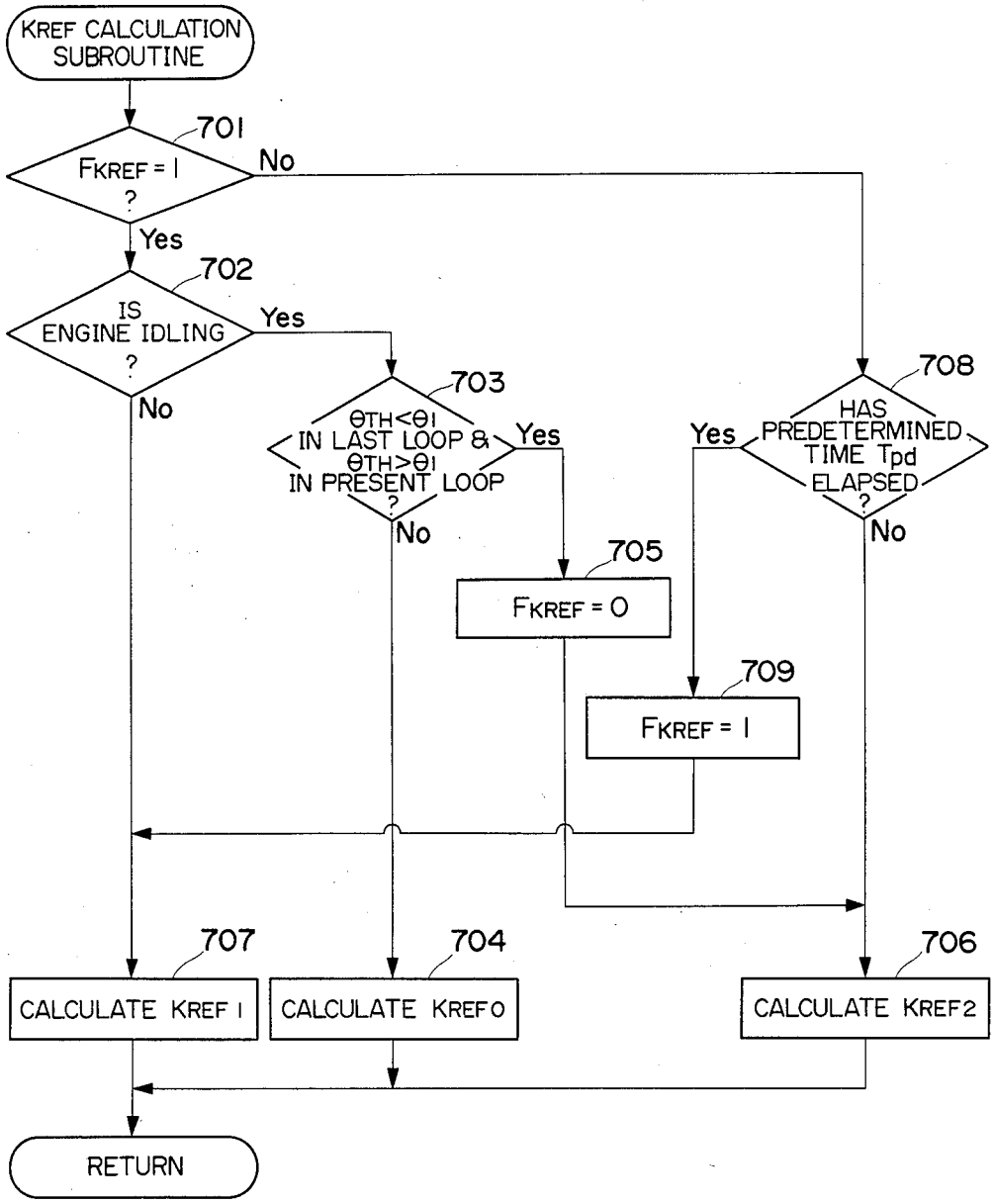
FIG. 7 is a flowchart showing in detail the step 440 in FIG. 6, in which is executed a subroutine for calculation of average values KREF of the correction coefficient KO2.
Figure 8:
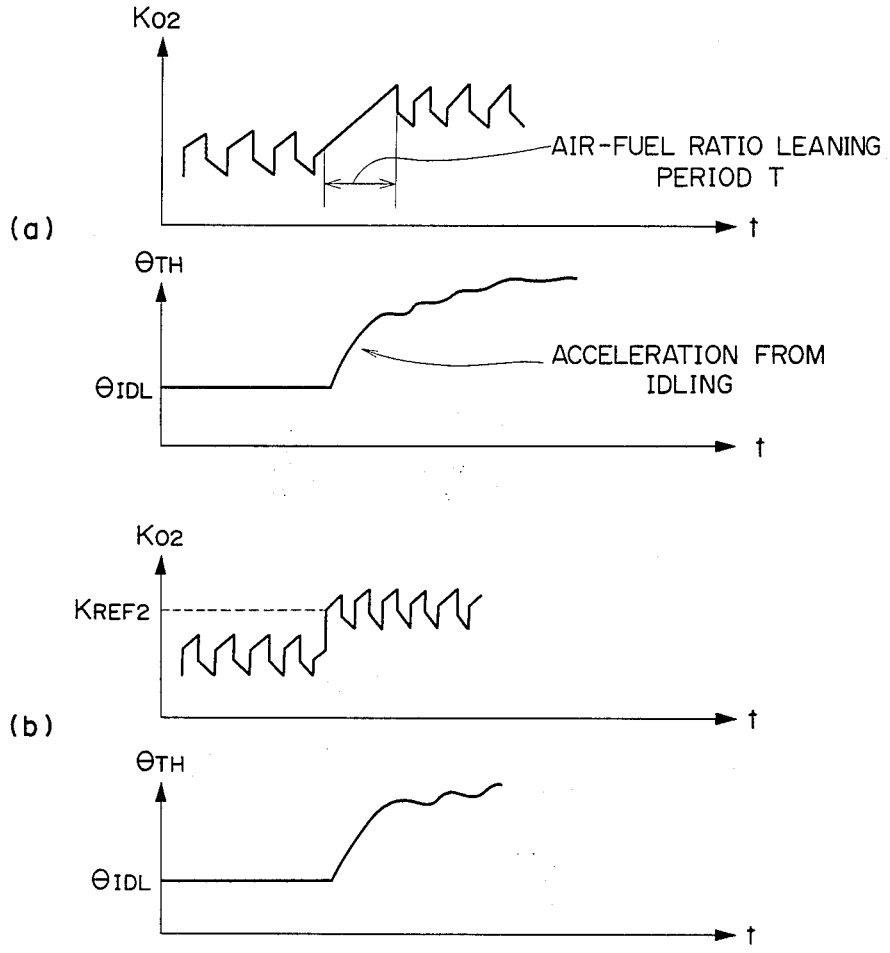
FIGS. 8(*a*) and 8(*b*) show graphs of control characteristics of the correction coefficient KO2 according to the conventional method and the method of the present invention.

If the answer to the question at step 444 is Yes, that is, if the engine operating condition has just shifted to the predetermined accelerating condition within the feedback control effecting region, the program proceeds to step 445 to set the air-fuel ratio correction coefficient KO2 to a value KREF2, which is a mean value of the correction coefficient KO2 obtained while the engine operating condition was in the predetermined accelerating condition, and is calculated at step 440 in a manner to be explained later with reference to the KREF calculation subroutine in FIG. 7. This value KREF2 is used as the initial value for the feedback control. When the engine operating condition has shifted from the idling region $I_2$ to the predetermined accelerating condition, the air-fuel ratio of the mixture gas becomes leaner, as explained before, and thus the value of the correction coefficient KO2 becomes large accordingly, so that the mean value KREF2 is greater than the mean value KREF0 obtained in the idling region $I_2$ and the mean value KREF1 obtained in the ordinary feedback control region II outside the predetermined accelerating condition. Therefore, when the opening of the throttle valve 3 increases beyond the predetermined value $\theta$1 so that the engine operating condition shifts from the idling region $I_2$ to the predetermined accelerating condition, the correction coefficient KO2 is suddenly increased to a large value corresponding to the mean value KREF2, as shown at (b) of FIG. 8. As a result, it is possible to overcome the disadvantage with the conventional method that the correction coefficient KO2 is gradually increased by the integral control at the time of shifting from the idling region $I_2$ to the predetermined accelerating condition, as shown in FIG. 8 (*a*) so that a time period T always exists during which the air-fuel ratio is lean and thus a considerable amount of NOx is emitted. After the execution of step 445, the conventional integral control is started (steps 441 et seq.)

On the other hand, if the answer to the question at step 444 is negative, the program proceeds to step 432 whereby no sudden increase in the correction coefficient KO2 is effected.

At the step 432 it is determined whether or not the output of the $O_2$ sensor 15 has been inverted between the last loop and the present loop, and if the answer is No, the program executes the aforementioned steps 441 et seq. to effect the integral control, whereas if the answer at step 432 is Yes, proportional control or P-term control of the air-fuel ratio or the correction coefficient KO2 is carried out in steps 437 et seq. That is, first at step 437, a determination is made as to whether or not the output of the $O_2$ sensor 15 has a lower level than a reference value. If the answer is Yes, a correction value P is added to the value of the correction coefficient KO2 (step 438), and if the answer is No, a correction value P is subtracted from the value of the correction coefficient KO2 (step 439). Thus, the correction value P is added to or subtracted from the value of the correction coefficient KO2 upon inversion of the output of the $O_2$ sensor, in a direction of compensating for the inversion of the $O_2$ sensor output. The correction value P is set as a function of the engine rotational speed Ne. The step 440 follows the execution of step 438 or step 439.

The value of the correction coefficient KO2 thus obtained during the proportional control is substituted into an equation (2) given below to obtain the average values KREF0, KREF1, and KREF2, which are applied, respectively, when the engine is operating in the idling region $I_2$, the ordinary feedback control effecting region II outside the predetermined accelerating condition, and the predetermined accelerating condition within the feedback control effecting region, and are stored into the RAM 508 (step 440).

$$KREFn = KO2P \times (CREF/A) + KREFn' \times (A - CREF)/A \quad (2)$$

where n is 0, 1, or 2, KO2P represents a value of KO2 obtained either at step 438 or 439, that is, a value of KO2 obtained immediately after the P-term control executed when the engine operation condition is in the respective region, A an averaging constant, CREF an averaging variable experimentally obtained, which is set at an appropriate value between 1 and A, and KREFn' a mean value of values of the correction coefficient KO2 obtained so far through past operation of the engine and stored.

Since the ratio of KO2P to KREFn' assumed in each execution of the P-term control is dependent on the variable CREF, it is possible to freely set the degree of precision of calculation of the mean value KREFn (KREF0, KREF1, and KREF2) by setting the CREF value at a value between 1 and A that best suits the type of an air-fuel ratio feedback control system, an engine, etc, to be applied.

The integral control of steps 441 et seq. is carried out as follows: First, at step 441, it is determined whether or not the output of the $O_2$ sensor 15 has a lower level than the reference value. When the answer is Yes, a predetermined value $\Delta I$ is added to the value of the coefficient KO2 (step 442) each time a predetermined number of pulses of the TDC signal are generated, while if the answer is No, the predetermined value $\Delta I$ is subtracted from the value of the coefficient KO2 each time a predetermined number of TDC signal pulses are generated (step 443), followed by termination of execution of the present loop. In this way, so long as the output of the $O_2$ sensor 15 maintains a lower level or a higher level with respect to the reference value, the predetermined value $\Delta I$ is added to or subtracted from the correction coefficient KO2 value so as to compensate for the low or high level of the output of the $O_2$ sensor 15.

Next, the procedure of the KREF calculation subroutine executed at step 440 in FIG. 6 will be explained with referrence to the flowchart of FIG. 7.

First, at step 701, it is determined whether or not a value of 1 is assumed by a flag FKREF which is reset and set at steps 705 and 709, respectively, as described later. This flag is set to 1 in the first loop executed when this subroutine is started. If the answer is Yes, it is determined at the step 702 whether or not the engine is operating in the idling region I. The determination at step 702 is made in a manner shown in the flowchart of FIG. 3, which is identical with the determination at the step 31 in FIG. 3.

If the answer to the question at step 702 is Yes, a determination is made at step 703, similarly to the step 444 in FIG. 6, as to whether or not the throttle valve opening θTH detected in the last loop was smaller than the predetermined valve opening value θ1 and at the same time that detected in the present loop is greater than the predetermined valve opening value θ1. If the answer to this is No, it is assumed that the engine is operating in the idling region $I_2$, whereupon the mean value KREF0 of KO2 for idling operation is calculated by means of the equation (2) (step 704), and the program terminates.

If the answer to the question at step 703 is Yes, it is assumed that the engine operating condition has just shifted to the predetermined accelerating condition within the feedback control effecting region, whereupon the flag FKREF is reset to zero (step 705), and the mean value KREF2 of KO2 for acceleration operation is calculated by means of the equation (2) (step 706), and then the program terminates.

If the answer to the question at step 702 is No, it is assumed that the engine is not in the idling region I but in the ordinary feedback control region II outside the predetermined accelerating condition, and thus the mean value KREF1 of KO2 for off-idle operation is calculated by means of the equation (2) (step 707), and then the program terminates.

On the other hand, if the answer to the question at step 701 is No, it is determined at step 708 whether or not a predetermined time period Tpd (e.g. 5 sec) has elapsed since it was determined that the throttle valve opening increased beyond θTH when the engine was operating in the idling region $I_2$ (i.e. since both the answers to the questions at steps 702 and 703 became Yes). The predetermined time period Tpd corresponds to a time period following the start of acceleration, during which the mixture is temporarily leaned. Therefore, to compensate for this leaning, the mean value KREF2 of KO2 for acceleration operation is calculated based on the values of the air-fuel ratio correction coefficient KO2 that tend to make the air-fuel ratio richer, over the predetermined time period Tpd. Then if the answer to the question at step 708 is No, the mean value KREF2 of KO2 for acceleration operation is calculated by means of the equation (2) (step 706), and then the program terminates. If the answer to step 708 is Yes, the flag FKREF is set to 1 (step 709), and the mean value KREF1 of KO2 for off-idle operation is calculated by means of the equation (2) (step 707), and then the program terminates.

What is claimed is:

1. A method of controlling in a feedback manner the air-fuel ratio of an air-fuel mixture being supplied to an internal combustion engine having an exhaust passage and an exhaust gas ingredient concentration sensor arranged in said exhaust passage, wherein a basic value of a fuel quantity to be supplied to said engine is determined, a correction coefficient which varies in response to output from said exhaust gas ingredient concentration sensor is determined, and said basic value of said fuel quantity is corrected by means of said correction coefficient, when said engine is operating in an air-fuel ratio feedback control effecting region, the method comprising the steps of:

(1) determining whether or not said engine is operating in a predetermined idling region;

(2) calculating a first mean value of said correction coefficient determined during a period during which said engine is operating in said predetermined idling region, when said engine is determined to be operating in said predetermined idling region;

(3) determining whether or not said engine is operating in a predetermined condition accelerating from said predetermined idling region;

(4) calculating a second mean value of said correction coefficient and then storing and holding it when said engine is determined to be operating in said predetermined accelerating condition; and (5) effecting said air-fuel ratio feedback control using said stored and held second mean value as an initial value of said correction coefficient, when said engine subsequently enters said predetermined accelerating condition from said predetermined idling region.

2. A method as claimed in claim 1, wherein said predetermined accelerating condition is a condition into which said engine shifts from an idling region as the opening of a throttle valve provided in said engine increases across a predetermined value.

3. A method as claimed in claim 2, wherein said predetermined accelerating condition lies within said air-fuel ratio feedback control effecting region.

4. A method as claimed in claim 1, wherein said calculation of said second mean value of said correction coefficient is carried out for a predetermined time period which corresponds to a time period following the start of acceleration, during which said mixture is temporarily leaned after said engine has shifted to said predetermined accelerating condition.

5. A method as claimed in claim 1, wherein said said air-fuel ratio feedback control is effected in a manner such that when the output from said exhaust gas ingredient concentration sensor remains either higher than a predetermined reference level or lower than same, said correction coefficient is varied by integral control at a smaller rate, and when the output from said sensor changes across said predetermined reference level, said correction coefficient is varied by proportional control at a larger rate.

6. A method as claimed in claim 1, further including the steps of:

determining whether or not said engine is operating in a predetermined ordinary feedback control effecting region other than said predetermined idling region and said predetermined accelerating condition;

calculating a third mean value of said correction coefficient and then storing and holding it, when said engine is determined to be operating in said predetermined ordinary feedback control effecting region; and effecting said air-fuel ratio control feedback control using said stored and held third mean value as an initial value of said correction coefficient, when said engine subsequently enters said predetermined ordinary feedback control effecting region from said predetermined accelerating condition.

* * * * *